US009683725B2

(12) United States Patent
Scribante et al.

(10) Patent No.: US 9,683,725 B2
(45) Date of Patent: Jun. 20, 2017

(54) LIGHT FIXTURE WITH TOOL-LESS INTERCHANGEABLE LENSES

(71) Applicant: Orion Energy Systems, Inc., Manitowoc, WI (US)

(72) Inventors: John Scribante, Manitowoc, WI (US); Matthew S. Tlachac, Manitowoc, WI (US); Zachary Kurtz, Manitowoc, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 239 days.

(21) Appl. No.: 14/697,334

(22) Filed: Apr. 27, 2015

(65) Prior Publication Data

US 2016/0102845 A1 Apr. 14, 2016

Related U.S. Application Data

(63) Continuation of application No. 14/509,910, filed on Oct. 8, 2014, now Pat. No. 9,016,892.

(51) Int. Cl.

| | |
|---|---|
| ***F21V 17/00*** | (2006.01) |
| ***F21V 5/04*** | (2006.01) |
| ***F21V 29/76*** | (2015.01) |
| *F21S 8/06* | (2006.01) |
| *F21V 9/08* | (2006.01) |
| *F21V 23/00* | (2015.01) |
| *F21V 23/04* | (2006.01) |
| *F21Y 113/00* | (2016.01) |
| *F21V 29/74* | (2015.01) |
| *F21Y 103/10* | (2016.01) |
| *F21Y 115/10* | (2016.01) |

(52) U.S. Cl.

CPC ..... *F21V 17/002* (2013.01); *F21V 5/04* (2013.01); *F21V 29/763* (2015.01); *F21S 8/06* (2013.01); *F21V 9/08* (2013.01); *F21V 23/009* (2013.01); *F21V 23/0471* (2013.01); *F21V 29/74* (2015.01); *F21Y 2103/10* (2016.08); *F21Y 2113/00* (2013.01); *F21Y 2115/10* (2016.08)

(58) Field of Classification Search

None

See application file for complete search history.

(56) References Cited

U.S. PATENT DOCUMENTS

| | | | |
|---|---|---|---|
| 5,823,663 | A | 10/1998 | Bell et al. |
| 6,908,212 | B2 | 6/2005 | Schultz |
| 7,686,470 | B2 | 3/2010 | Chiang |
| 8,038,314 | B2 | 10/2011 | Ladewig |

(Continued)

*Primary Examiner* — Britt D Hanley

(74) *Attorney, Agent, or Firm* — Foley & Lardner LLP

(57) ABSTRACT

A light fixture includes a housing with a channel configured to contain a driver for driving one or more light emitting diodes located outside the channel. The housing includes slots configured to receive and secure a lens. The light fixture further includes a removable channel cover, tabs located along the length of the channel and adjacent to the channel on the housing, and a lens bar having a first flange configured to secure the lens and a second flange configured to be inserted underneath the tabs. The lens bar is secured in place with the second flange underneath the tabs by the channel cover which prevents the lens bar from moving laterally with respect to the tabs. The slots, the first flange, and a flange running the length of the light fixture perpendicular to the slots are configured to cover the edges of the lens when installed.

16 Claims, 7 Drawing Sheets

(56) References Cited

U.S. PATENT DOCUMENTS

| | | | |
|---|---|---|---|
| 8,240,877 | B2 | 8/2012 | Kim et al. |
| 8,376,583 | B2 | 2/2013 | Wang et al. |
| D678,597 | S | 3/2013 | Lehman et al. |
| 8,523,383 | B1 | 9/2013 | Grigore et al. |
| 2007/0183156 | A1 | 8/2007 | Shan |
| 2007/0211457 | A1 | 9/2007 | Mayfield et al. |
| 2010/0091484 | A1 | 4/2010 | Mayfield et al. |
| 2012/0051041 | A1 | 3/2012 | Edmond et al. |
| 2013/0294060 | A1 | 11/2013 | Van Laanen et al. |

LIGHT FIXTURE WITH TOOL-LESS INTERCHANGEABLE LENSES

CROSS-REFERENCE TO RELATED APPLICATIONS

This application is a continuation of application Ser. No. 14/509,910, filed Oct. 8, 2014, which is hereby incorporated by reference herein in its entirety.

BACKGROUND

Generally, light fixtures such as those for high bay illumination applications include permanent lenses or no lenses. In some cases, a lens of a light fixture may be changed with the use of tools. For example, fasteners such as screws may be removed, one or more housing components may be removed, and then a lens may be removed. A new lens may be inserted and fastened into place using housing components and fasteners. In additional cases, a lens may be added to a light fixture using tools and/or fasteners. It is challenging and difficult to develop a light fixture with a tool-less system of adding, removing, and/or changing the lenses of the light fixture.

SUMMARY

One embodiment relates to a light fixture including a housing with a channel configured to contain a driver for driving one or more light emitting diodes located outside the channel. The housing includes slots configured to receive and secure a lens. The light fixture further includes a removable channel cover, tabs located along the length of the channel and adjacent to the channel on the housing, and a lens bar having a first flange configured to secure the lens and a second flange configured to be inserted underneath the tabs. The lens bar is secured in place with the second flange underneath the tabs by the channel cover which prevents the lens bar from moving laterally with respect to the tabs.

Another embodiment relates to a light fixture system for tool-less installation of lenses. The light fixture system includes a housing, a lens bar, and a cover. The housing includes a channel configured to house a driver for driving one or more light emitting diodes, a panel extending outward from the channel and configured to secure the one or more light emitting diodes, the panels further including tabs and furthering including slots to receive a lens, and an end plate including a slot configured to receive a lens and a cutout configured to allow the lens to be inserted into the slot. The lens bar includes a first flange configured to overhang a lens and secure the lens, a body portion, and a second flange configured to engage with the tabs of the housing to secure the lens bar to the housing. The cover is configured to be coupled to the housing over the channel, wherein the cover prevents lateral movement of the lens bar through inference between the cover ad the body portion of the lens bar.

Another embodiment relates to a method of installing a lens in a light fixture. The method includes removing a cover from a channel of the light fixture, inserting the lens through a cutout of the light fixture and into a slot, coupling a lens bar to the light fixture by inserting a second flange of the lens bar underneath a tab of the light fixture, wherein the lens bar includes a first flange which overhangs and secures the lens, and re-coupling the cover to the channel of the light fixture wherein the cover is configured to prevent the lens bar from disengaging with the tab.

DETAILED DESCRIPTION

Figure 1C:
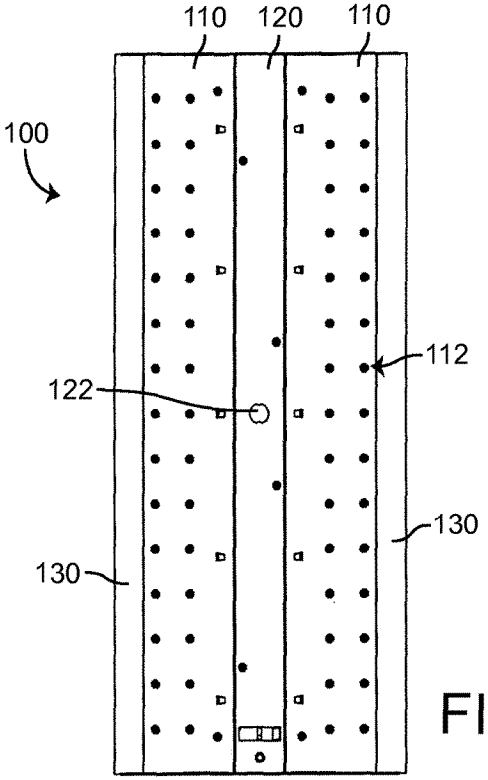
FIG. 1C is a top view of the light fixture of FIG. 1A according to an exemplary embodiment.

In the following detailed description, reference is made to the accompanying drawings. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the FIGURES generally, a light fixture 100 is illustrated according to embodiments of the invention. The light fixture 100 includes components and/or is otherwise configured to allow for a lens to be added to the light fixture 100, removed from the light fixture 100, and/or changed without the use of tools. Light fixture 100 may be sold or installed without a lens. A lens may be added later using one or more of the techniques and components described herein. Advantageously, the light fixture 100 includes components and/or is otherwise configured to allow for a lens to be added without the use of tools. This allows a lens to be added to light fixture 100 quickly and easily. In some embodiments, light fixture 100 may be sold with a lens or lenses installed. The lens(es) may be removed and/or replaced with different lenses using one or more of the techniques and components described herein. Advantageously, this allows for lenses to be added to light fixture 100 and/or the substitution of lenses with different qualities or characteristics without tools. For example, existing lenses may be replaced with lenses providing a different intensity of light, color of light, light distribution pattern, and/or other characteristics.

In one embodiment, the housing of light fixture 100 includes a plurality of slots (e.g., 154, 152, 144, 142, 132) or channels along the top, bottom, and sides of light fixture 100. These slots or channels are configured (e.g., shaped and sized) to receive a lens which is slid into the slots or channels. A lens bar (e.g., lens bar 220) may be inserted into tabs 180 running the length of and along a center channel of light fixture 100. The tabs 180 and/or a removable central cover 172 which abuts the lens bar 220 may removably couple the lens bar to light fixture 100. The lens bar may include a flange (e.g., first flange 224) which overhangs the installed lens in order to further secure the lens. Thus, a bezel or frame may be formed on all four side of the lens to secure the lens and/or provide an aesthetically pleasing appearance (e.g., the lens may be framed). The lens bar 220 secures the lens along the inner edge of the lens (e.g., the edge facing the center channel of the light fixture 100). Another lens bar (e.g., lens bar 210) may be installed on the other side of the center channel to secure a second lens on the opposite side of light fixture 100.

Figure 1E:
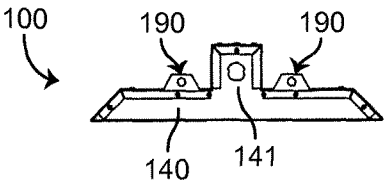
FIG. 1E is a front view of the light fixture of FIG. 1A according to an exemplary embodiment.
Figure 1A:
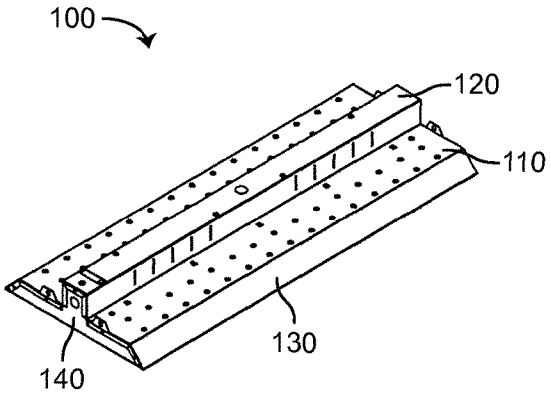
FIG. 1A is a top perspective view of a light fixture according to an exemplary embodiment.

Referring to FIGS. 1A-1E, light fixture 100 is shown according to one embodiment. Referring to FIG. 1A, a top perspective view of light fixture 100 is shown. In one embodiment, light fixture 100 may be an I-beam light fixture. Light fixture 100 has a main structure which may include a pair of panels, a central channel, and a pair of flanges. The pair of panels, shown as panels 110, are substantially rectangular in shape and are disposed on opposing lateral sides of the central channel, shown as channel 120. Channel 120 has a substantially rectangular cross section and extends the entire longitudinal length of light fixture 100. Channel 120 provides a cavity (see, e.g., FIG. 2A) configured to store at least one of a driver, ballasts, and other power systems or electronic components (e.g., controllers, automation systems, sensors, etc.) of light fixture 100. In alternative embodiments, light fixture 100 may have different configurations and/or geometries. For example, light fixture 100 may be square or substantially square, may include a plurality of channels, may be a light fixture type other than an I-beam (e.g., a troffer style light fixture), etc.

Figure 1D:
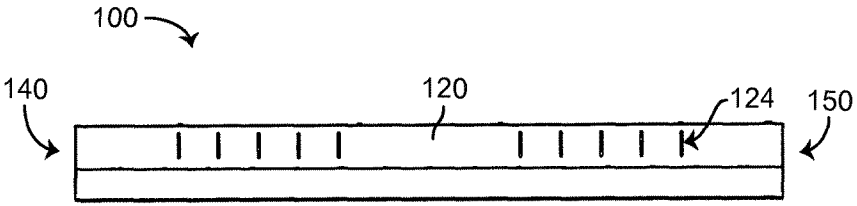
FIG. 1D is a left side view of the light fixture of FIG. 1A according to an exemplary embodiment.
Figure 2A:
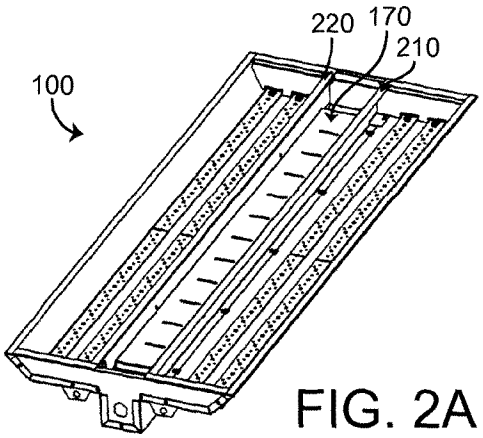
FIG. 2A is a bottom perspective view of a light fixture with lens brackets according to an exemplary embodiment.

As shown in FIG. 1C, the pair of flanges, shown as flanges 130, are disposed along the outer edge of each panel 110 (e.g., the edge opposite the connection to channel 120, etc.). Flanges 130 extend from the outer edge of panels 110 at a downward angle. In other embodiments, flanges 130 may extend perpendicularly (e.g., vertically, etc.) from the outer edge of panels 110. As shown in FIGS. 1A and 1D, a first end plate, shown as first end plate 140, is disposed at a first longitudinal end of light fixture 100 and a second end plate, shown as end plate 150, is disposed at a second longitudinal end of light fixture 100 (e.g., opposite the first longitudinal end, etc.). As shown in FIG. 1E, first end plate 140 is substantially trapezoidal in shape, defining the cross-sectional shape of light fixture 100. In other embodiment, the cross-sectional shape of light fixture 100 may be another shape (e.g., square, rectangular, triangular, etc.). First end plate 140 may include an aperture, shown as aperture 141. Aperture 141 provides an opening for various wires leading to the driver, ballasts, and/or other power systems or electronics within the channel 120. Aperture 141 may be normally closed and may be opened by punching out a knockout. Aperture 141 may allow for access to electrical components of light fixture 100 such that additional features may be installed in or on light fixture 100. For example, a motion sensor may be added externally to light fixture 100 and wired to a control circuit within light fixture 100 using aperture 141 to gain access to the control circuit. The motion sensor may be used to control the output of light from the light fixture 100 (e.g., control a driver powering one or more light emitting diodes). By way of example, second end plate 150 has a substantially identical shape as first end plate 140 and may include an aperture substantially similar to aperture 141 of first end plate 140.

Figure 1B:
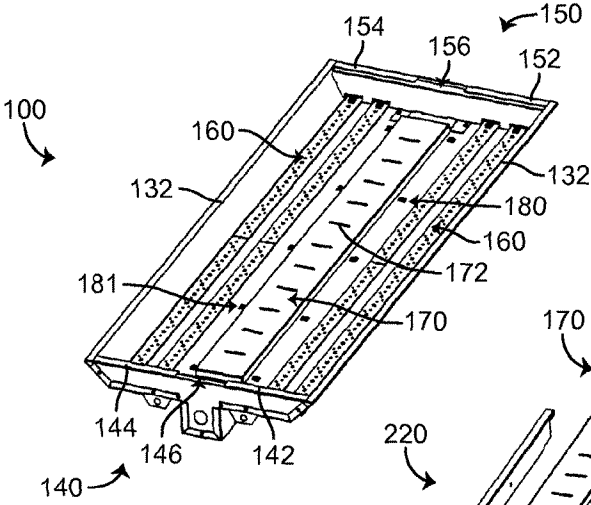
FIG. 1B is a bottom perspective view of the light fixture of FIG. 1A with LED strips according to an exemplary embodiment.
Figure 2C:
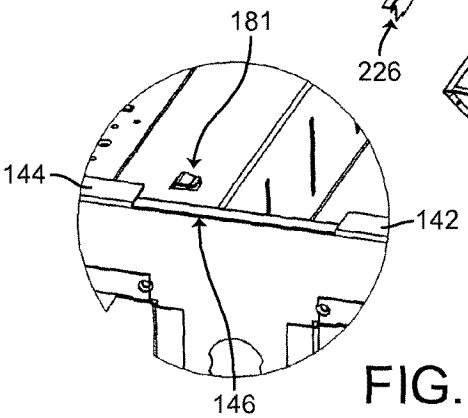
FIG. 2C is a detailed view of a coupling mechanism to secure the lens brackets to the light fixture of FIG. 2A according to an exemplary embodiment.

Referring now to FIG. 1B, a bottom perspective view of light fixture 100 is shown. As shown in FIG. 1B, light fixture 100 includes a plurality of lamps, shown as light emitting diode (LED) strips 160. The LED strips 160 are disposed longitudinally along the underside (e.g., bottom surface, the undersurface, etc.) of panels 110. In the example embodiment, light fixture 100 includes four rows of LED strips 160, two rows disposed on each lateral side of driver cover 170. In other embodiments, the number of rows of LED strips 160 on each lateral side of the driver cover 170 may vary (e.g., one, three, five, etc.). Driver cover 170 is positioned directly below channel 120. Driver cover 170 is removably attached (e.g., detachable, etc.) to the underside of the panels 110, providing a cover to the cavity created by the channel 120. When removed, the electronic components stored within the cavity of channel 120 (e.g., the driver, ballasts, wires, a control circuit, motion sensor, other sensors, etc.) may be accessed. Driver cover 170 includes a plurality of slits in some embodiments, shown as slits 172. Slits 172 provide the electronic components within channel 120 a source of convective cooling through air flowing from the ambient environment into the cavity through slits 172. The air flow thereby cools the components of the light fixture 100 that are enclosed within the cavity defined by the channel 120 and driver cover 170. A plurality of tabs, shown as first row of tabs 180 and second row of tabs 181, are coupled to the underside of panels 110. Tabs 180 and 181 allow for lens bars 220 and 210, used for the tool-less installation of lenses as described with reference to FIGS. 8-10, to be removably coupled to panels 110. In other embodiments, the tabs 180 and 181 may be replaced by other features which allow for tool-less connection of lens bars 220 and 210 to panels 110. For example, quarter turn fasteners, a single longitudinal tab or slot running a length of panels 110, and/or other fastener (s) that allow for components to be coupled and decoupled without the use of tools may be used.

Light fixture 100 may provide a volumetric, even distribution of light with high quality color rendering. The color temperature of LED strips 160 may also be customizable and/or changed (e.g., controlled with a controller, selected during manufacture, etc.). Therefore, the light produced by LED strips 160 may be of superior quality in comparison to light produced by other lamps (e.g., florescent, etc.). While LEDs are specifically used in many of the examples described, other types of lamps or light sources (e.g., fluorescent lamps, halogen lamps, incandescent lamps, organic LEDs, incandescent lamps, discharge lamps, liquid crystal displays, plasma displays, and/or other light sources) may be used in varying embodiments. Any components or deices configured to or capable of producing light may be used in conjunction with or in place of LEDs described herein. A variety of light sources or lamps of varying types may be used alone or in combination to produce light.

As shown in FIG. 1C, panels 110 may include a plurality of apertures, shown as apertures 112. Apertures 112 provide mounting locations to which heat transferring elements may be fastened, which is described more fully herein. Channel 120 may include an aperture, shown as aperture 122. Aperture 122 provides an opening for various wires leading to the driver, ballasts, and/or other power systems or electronics (e.g., controllers, automation systems, sensors, etc.) within the channel 120. As shown in FIG. 1D, channel 120 of light fixture 100 may include a plurality of slits, shown as slits 124, along both of the laterally outwards facing surfaces of channel 120. The slits 124 provide light fixture 100 and the various components of light fixture 100 located within the channel 120 with a second source of convective cooling substantially similar to slits 172, as mentioned above. As shown in FIG. 1E, light fixture 100 may include hangers, shown as hangers 190. There is a single hanger 190 coupled to each longitudinal edge of each panel 110 (i.e., four hangers 190) in one embodiment. In other embodiments, there may be two or more hangers 190 coupled to each longitudinal edge of panels 110. The hangers 190 provide mounting locations from which light fixture 100 may be hung from (e.g., to a ceiling, recessed in a ceiling, etc.). In even further embodiment, hangers 190 may be positioned off of the edges (e.g., on the interior of the outer perimeter, etc.) of panels 110. Hangers 190 include a flange and opening in one embodiment. The opening allows for wire or cable to be passed through the opening of hanger 190 and to be attached to a mounting mechanism, ceiling, or otherwise secure light fixture 100.

Referring now to FIGS. 1B and 2A-2C, in one embodiment, light fixture 100 may include lenses. Lenses may be included to allow for various characteristics of the light emitted by the LED strips 160 to be altered. For example, a lens may include a color filter that alters the color of the visible light being emitted from light fixture 100. Also, a lens may include a tint feature that decreases the intensity (e.g., reduces the brightness, etc.) of the light being emitted from light fixture 100. Another alternative is that the lens may include a directional feature which directs light towards a selected location. Therefore, the lenses allow for easy customizability without having to change the lamps (e.g., LED strips 160, etc.), hardware, and/or lighting components (e.g., drivers, ballasts, wiring, etc.).

As shown in FIG. 1B, first end plate 140 includes first slot 142, second slot 144, and first cutout 146. Second end plate 150 includes first slot 152, second slot 154, and second cutout 156. Slots 142, 144, 152, and 154 are configured to overhang a flange of end plates 140 and 150. A lens may be inserted into the slot (e.g., slot 144) through cutout 146 (e.g., an opening in which the upper surface of slots 144 and 142 is not continuous). The slot (E.g., slot 144) prevents the lens from moving vertically with respect to light fixture 100 as the lens is held in place by the slot (e.g., slot 144) overhanging the lens and a flange portion of the end plate (e.g., end plate 140) securing the lens from the opposite direction.

Figure 2B:
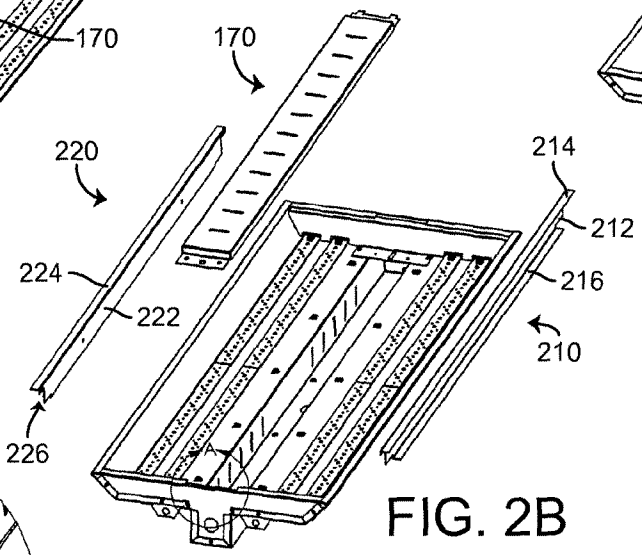
FIG. 2B is an exploded bottom perspective view of the light fixture of FIG. 2A according to an exemplary embodiment.

Flanges 130 may include slots, shown as end slots 132, disposed along a bottom edge of each flange 130. End slots 132 may be flanges or slots which overhang a lens to prevent movement of the lens vertically with respect to light fixture 100. End slots 132 may further prevent movement of the lens away from channel 120 as the lens encounters interference by the overhang of flange 130 and end slots 132. As shown in the exemplary embodiment of FIG. 2A-2B, light fixture 100 includes first lens bar 210 and second lens bar 220. First lens bar 210 and second lens bar 220 are configured to secure lenses onto light fixture 100. As shown in FIG. 2B, first lens bar 210 includes body portion 212 which extends the longitudinal length of the light fixture 100. Disposed along a first edge of body portion 212 is a flange, shown as first flange 214. First flange 214 is configured to overhang a lens when the lens and lens bar 210 are installed in light fixture 100. First flange 214 prevents lateral and/or vertical movement of the lens relative light fixture 100. Disposed along a second edge of body portion 212 is a second flange, shown as second flange 216. Second flange 216 is configured to be inserted into tabs 180 in order to secure lens bar 210 to light fixture 100. Tabs 180 and second flange 216 prevent lateral movement of lens bar 210 away from channel 120 and/or prevent vertical movement of lens bar 210 (e.g., second flange 216 is hend in place under tabs 180). Lateral movement towards channel 120 is prevented by interference caused by cover 170 when installed (e.g., between lens bars 210 and 220). Second lens bar 220 includes body portion 222 which extends the longitudinal length of the light fixture 100. Disposed along a first edge of body portion 222 is a flange, shown as first flange 224. Disposed along a second edge of body portion 222 is a second flange, shown as second flange 226. The features of second lens bar 220 are similar or the same as to those described with reference to first lens bar 210.

When installing lenses onto light fixture 100 or interchanging lenses, the assembly process is able to be performed without the use of tools (e.g., tool-less installation, etc.). The assembly process is explained in reference to FIGS. 1B and 2A-2C. For example, the diver cover 170 is first removed (e.g., detached, uncoupled, etc.) from the light fixture 100. A first lens is inserted through first cutout 146 and second cutout 156, underneath first slots 142 and 152 and end slot 132. Slot 132 may be a void (e.g., channel) formed by flange portion extending at an angle (e.g., substantially horizontal) from flange 130 of the body of light fixture 100. The flange portion defining slot 132 may be configured to overhang a lens when inserted into light fixture 100. Second flange 216 of first lens bar 210 engages the first row of tabs 180, coupling first lens bar 210 to light fixture 100. In other embodiments, the tabs 180 may be a single longitudinal tab which engages the entire length of second flange 216 (e.g., a tongue and groove fastener, etc.). In ever further embodiments, the tabs 180 may be quarter turn locking fasteners which align with a plurality of corresponding apertures along second flange 216. The first flange 214 of first lens bar 210 secures the free end (e.g., opposite the end secured by end slot 132, etc.) of the first lens. Tabs 180 may be replaced by holes which align with quarter turn screw fasteners included in second flange 216 of first lens bar 210. The quarter turn screws can be inserted into the holes and turned to fastener lens bar 210 to light fixture 100 and prevent vertical and/or horizontal movement of lens bar 210.

Following the installation of the first lens, a second lens is installed. The second lens is inserted through first cutout 146 and second cutout 156, underneath second slots 144 and 154 and end slot 132. Second flange 226 of second lens bar 220 engages the second row of tabs 181, coupling second lens bar 220 to light fixture 100. In other embodiments, the tabs 181 may be a single longitudinal tab which engages the entire length of second flange 226. In ever further embodiments, the tabs 181 may be quarter turn locking fasteners which align with a plurality of corresponding apertures along second flange 216. The first flange 224 of second lens bar 220 secures the free end (e.g., opposite the end secured by end slot 132, etc.) of the second lens. In other embodiments, the order of which first lens bar 210 and second lens bar 220 are installed may be reversed (e.g., second lens bar 220 may be installed first, etc.) or only one lens bar may be installed. In some embodiments, tabs 180 and 181 may be omitted. For example, first lens bar 210 and second lens bar 220 may be coupled to light fixture 100 via a hinge mechanism. When either installing or changing lenses, first lens bar 210 and second lens bar 220 may be unlocked from a fixed position and able to rotate about a hinge to allow the lenses to be removed or installed in their respective locations. In other embodiments, lens bars 210 and 220 are completely removable to allow for the changing, instillation, and/or removal of a lens. Lens bars 210 and 220 may be removed from tabs 180 and uncoupled from light fixture 100 in order to allow for a lens to be removed or inserted.

Following both lenses, first lens bar 210, and second lens bar 220 being installed, driver cover 170 is returned to its original location (e.g., coupled to light fixture 100, etc.). The driver cover 170 substantially prevents both first lens bar 210 and second lens bar 220 retracting laterally inwards from the tabs 180 and 181. The tabs 180 and 181 substantially prevent first lens bar 210 and second lens bar 220 from moving both laterally outward and in a vertical direction. Thereby, first lens bar 210 and second lens bar 220 become fixed in their respective locations, securing both the first lens and the second lens to light fixture 100. In other embodiments, only one of the first and second lenses may be installed (e.g., one side of light fixture 100 does not include a lens, etc.). Cover 170 may be secured in place using a latch on one end which is configured to secure cover 170 to a receiver in channel 120 and/or tabs on the other end of cover 170 configured to be inserted into a receiver of channel 120. In alternative embodiments, cover 170 may be removably secured to light fixture 100 using other tool-less components or methods. For example, quarter turn screws may be used.

Figure 3B:
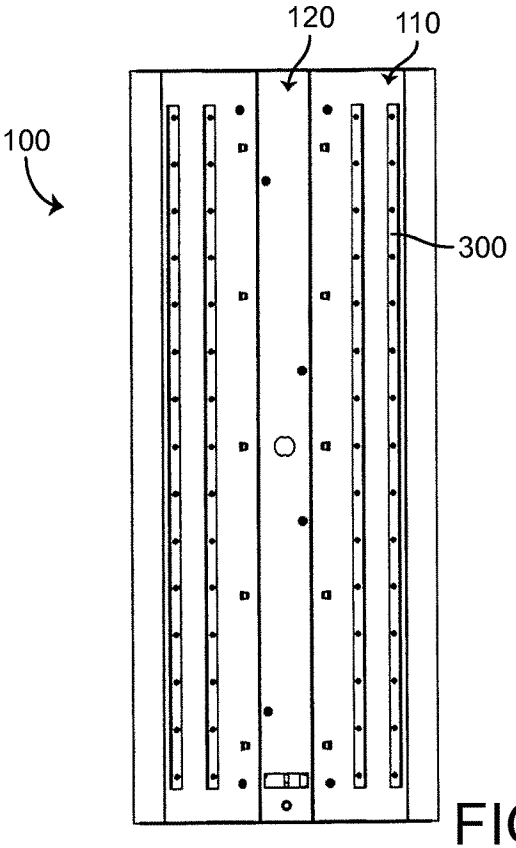
FIG. 3B is a top view of the light fixture of FIG. 3A according to an exemplary embodiment.
Figure 3D:
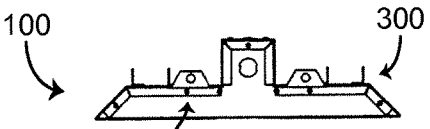
FIG. 3D is a front view of the light fixture of FIG. 3A according to an exemplary embodiment.
Figure 3A:
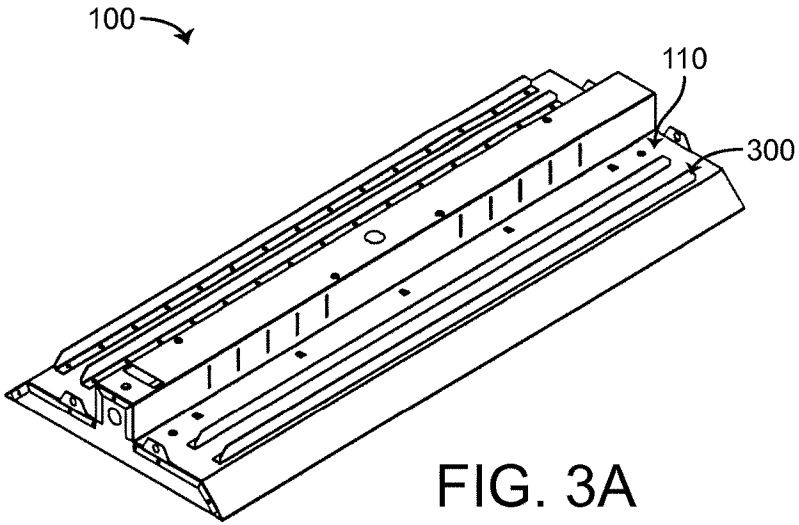
FIG. 3A is a top perspective view of a light fixture with fins according to an exemplary embodiment.
Figure 3C:
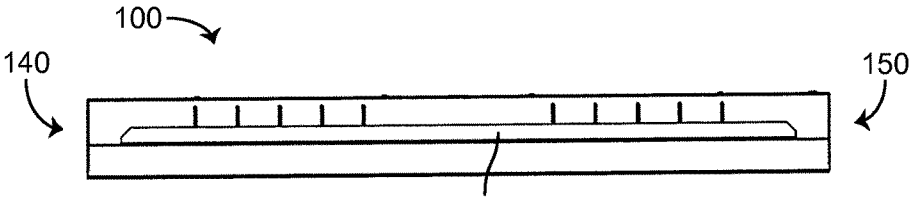
FIG. 3C is a left side view of the light fixture of FIG. 3A according to an exemplary embodiment.

According to the exemplary embodiment shown in FIGS. 3A-3D, light fixture 100 may include heat transferring elements, shown as fins 300. Fins 300 may be coupled to panels 110 via a plurality of fasteners (e.g., clips, screws, nails, rivets, bolts, etc.) engaging with apertures 112 positioned along panels 110, as mentioned above (see FIG. 1C). Fins 300 extend outward from panels 110 into the surrounding environment. Fins 300 are shown to have a uniform cross-section (e.g., a straight fin of uniform cross-section, etc.). In other embodiments, fins 300 may have a cross-sectional area which varies with the distance fins 300 extend from panels 110 (e.g., a straight fin of non-uniform cross-section, triangular fins, parabolic fins, etc.). As shown in FIG. 3B, the number of fins 300 corresponds with the number of rows of LED strips 160 of light fixture 100 (e.g., four, etc.). In other embodiments, there may be more or less fins 300 than LED strips 160. The fasteners used to secure fins 300 to panels 110 may further be used to secure LED strips 160 to panels 110. The fasteners may provide for heat transfer from the LED strips 160 to fins 300 for dissipation outside of light fixture 100. In some embodiments, LED strips 160 are coupled to panels 110 using fasteners which extend through panels 110. Fins 300 may be optionally added to light fixture 100 by attaching fins 300 to the exposed fasteners. For example, fins 300 may include holes which align with the fasteners, and one or more nuts or other fasteners may be used to secure fins 300 to the exposed fasteners passing through holes in fins 300.

During operation, the lamps (e.g., LED strips 160, etc.) emit light (e.g., radiant energy, electromagnetic radiation that is visible to the human eye, etc.). While emitting light, the lamps produce thermal energy (e.g., heat, etc.) as well. The heat generated by the lamps may need to be substantially removed from light fixture 100 to allow for optimal performance. The rate of heat transfer (i.e., heat removed from light fixture 100, etc.) may be increased by increasing the surface area across which convection occurs (e.g., heat transfer from the movement of fluid, etc.). Fins 300 may be used to increase the surface area of light fixture 100, thereby increasing the rate of convection. Therefore, fins 300 may be installed to increase the rate of heat transfer from the lamps of light fixture 100 to the surrounding environment (e.g., ambient environment, surrounding air, etc.), reducing the overall temperature of the light fixture 100.

Figure 6:
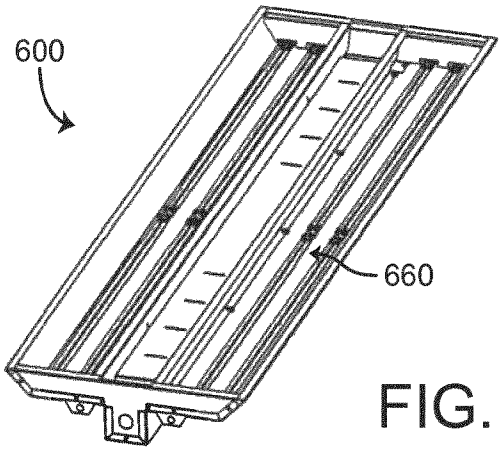
FIG. 6 is a bottom perspective view of a light fixture with medium power LEDs outputting up to 200 watts of energy according to an exemplary embodiment.
Figure 4:
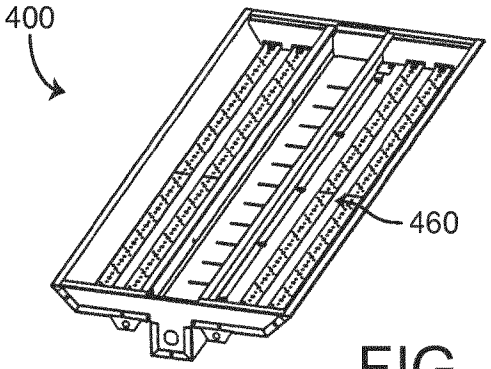
FIG. 4 is a bottom perspective view of a light fixture with high power LEDs outputting up to 200 watts of energy according to an exemplary embodiment.

According to the exemplary embodiments shown in FIGS. 4-7, light fixture 100 may be reconfigured to include various different number of lamps and number of rows of lamps. Also, light fixture 100 may be reconfigured to emit a wide variety of light intensities and total power outputs. As shown in FIG. 4, light fixture 400 includes four rows of LED strips 460. The LED strips 460 include a plurality of high power LEDs which produce up to 200 watts (W) of light energy. Referring now to FIG. 6, light fixture 600 also includes four rows of LED strips, shown as LED strips 660. The LED strips 660 also produce up to 200 W of light energy, but with a greater plurality of medium power LEDs than the high powered LED strips 460 of light fixture 400.

Figure 7:
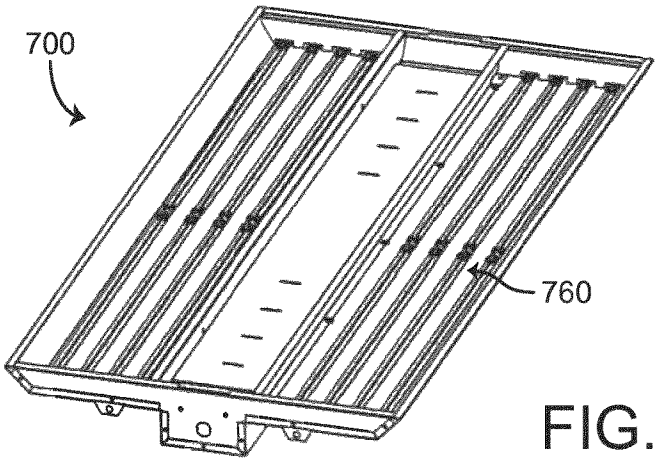
FIG. 7 is a bottom perspective view of a light fixture with medium power LEDs outputting between 200 and 400 watts of energy according to an exemplary embodiment.
Figure 5:
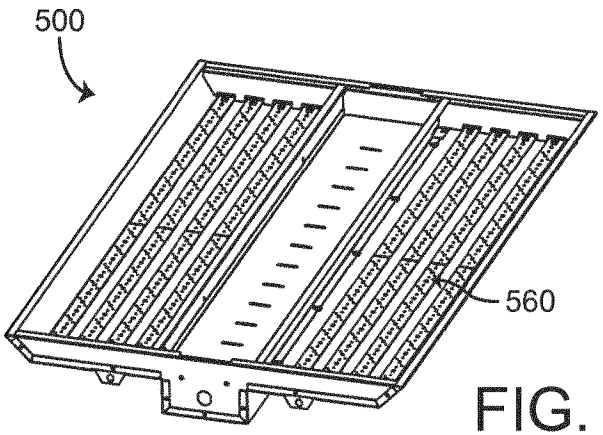
FIG. 5 is a bottom perspective view of a light fixture with high power LEDs outputting between 200 and 400 watts of energy according to an exemplary embodiment.

As shown in FIG. 5, light fixture 500 includes eight rows of LED strips 560. The LED strips 560 include a plurality of high power LEDs which produce between 200 W to 400 W of light energy. Referring now to FIG. 7, light fixture 700 also includes eight rows of LED strips, shown as LED strips 760. The LED strips 760 also produce 200 W to 400 W of light energy, but with a greater plurality of medium power LEDs than the high powered LED strips 560 of light fixture 500.

Figure 8:
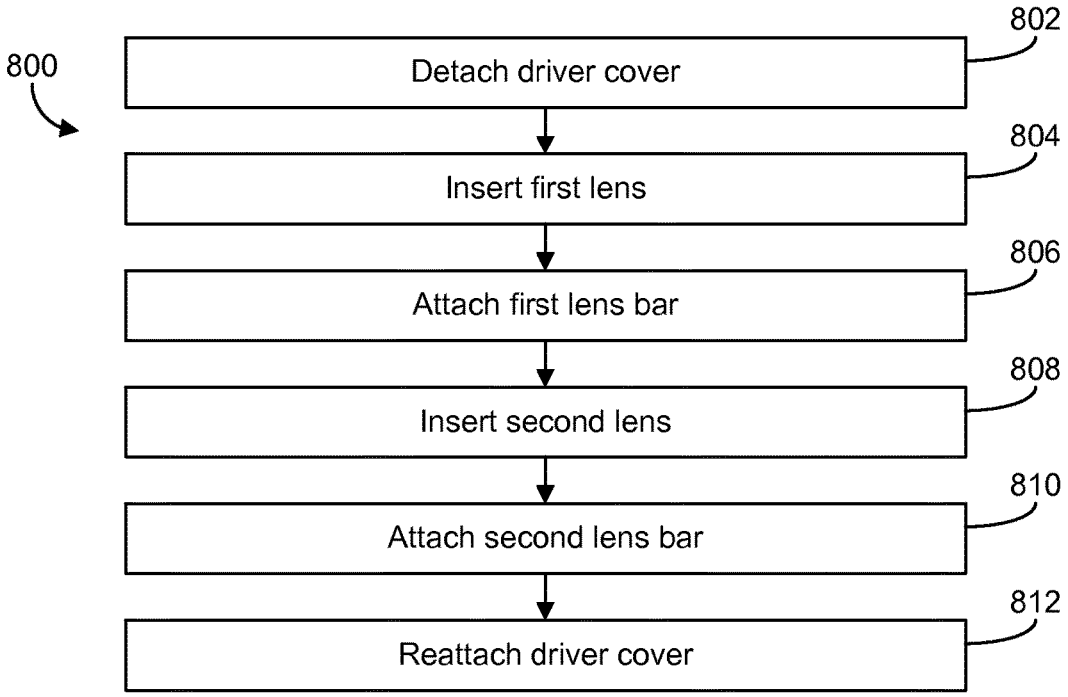
FIG. 8 is a flow chart of installing lenses onto the light fixture of FIG. 1A according to an exemplary embodiment.

Referring now to FIG. 8, a method 800 of installing lenses onto light fixture 100 is shown according to an example embodiment. In one example embodiment, method 800 may be implemented without the use of tools. Method 800 may be described in regard to FIGS. 1B and 2A-2C.

At step 802, driver cover 170 is detached from light fixture 100. At step 804, a first lens is inserted into light fixture 100. For example, the first lens is inserted through first cutout 146 and second cutout 156, underneath first slots 142 and 152 and end slot 132. At step 806, first lens bar 210 is attached. For example, second flange 216 of first lens bar 210 engages the first row of tabs 180, coupling first lens bar 210 to light fixture 100. The first flange 214 of first lens bar 210 secures the free end (e.g., opposite the end secured by end slot 132, etc.) of the first lens. Following the installation of the first lens, at step 808, a second lens is inserted into light fixture 100. For example, the second lens is inserted through first cutout 146 and second cutout 156, underneath second slots 144 and 154 and end slot 132. At step 810, second lens bar 220 is attached. For example, second flange 226 of second lens bar 220 engages the second row of tabs 181, coupling second lens bar 220 to light fixture 100. The first flange 224 of second lens bar 220 secures the free end (e.g., opposite the end secured by end slot 132, etc.) of the second lens. At step 812, driver cover 170 is reattached to light fixture 100. The driver cover 170 substantially prevents both first lens bar 210 and second lens bar 220 retracting laterally inwards from the tabs 180 and 181. The tabs 180 and 181 substantially prevent first lens bar 210 and second lens bar 220 from moving both laterally outward and in a vertical direction. Thereby, first lens bar 210 and second lens bar 220 become fixed in their respective locations, securing both the first lens and the second lens to light fixture 100.

Figure 9:
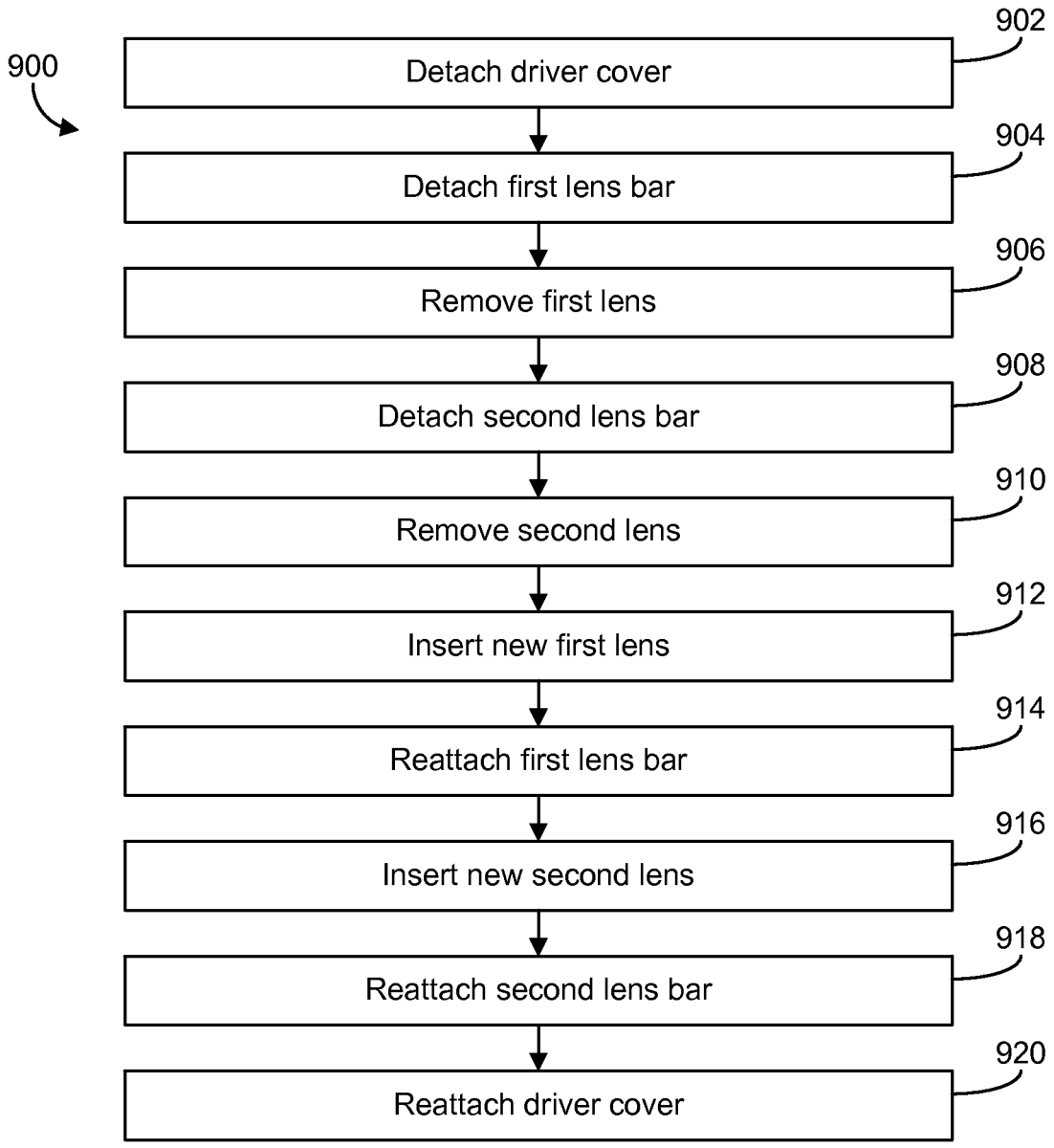
FIG. 9 is a flow chart of changing lenses on the light fixture of FIG. 2A according to an exemplary embodiment.

Referring now to FIG. 9, a method 900 of replacing lenses of light fixture 100 is shown according to an example embodiment. In one example embodiment, method 900 may be implemented without the use of tools. Method 900 may be described in regard to FIGS. 1B and 2A-2C.

At step 902, driver cover 170 is detached from light fixture 100. By removing driver cover 170, first lens bar 210 and second lens bar 220 are able to move laterally inward. At step 904, first lens bar 210 is detached from light fixture 100. For example, with driver cover 170 detached, first lens bar 210 may be decoupled from tabs 180 by moving first lens bar 210 laterally inward (e.g., towards the center, towards the cavity of channel 120, etc.), disengaging second flange 216 from tabs 180. At step 906, the first lens is removed from light fixture 100. For example, the first lens is pulled from the free end (e.g., end which was engaging first flange 214 of first lens bar 210, etc.) out through first and second openings 146 and 156. At step 908, second lens bar 220 is detached from light fixture 100. For example, with driver cover 170 detached, second lens bar 220 may be decoupled from tabs 181 by moving second lens bar 220 laterally inward (e.g., towards the center, towards the cavity of channel 120, etc.), disengaging second flange 226 from tabs 181. At step 910, the second lens is removed from light fixture 100. For example, the second lens is pulled from the free end (e.g., end which was engaging first flange 224 of second lens bar 220, etc.) out through first and second openings 146 and 156.

At step 912, a new first lens is inserted into light fixture 100. For example, the new first lens is inserted through first cutout 146 and second cutout 156, underneath first slots 142 and 152 and end slot 132. At step 914, first lens bar 210 is reattached. For example, second flange 216 of first lens bar 210 engages the first row of tabs 180, coupling first lens bar 210 to light fixture 100. The first flange 214 of first lens bar 210 secures the free end (e.g., opposite the end secured by end slot 132, etc.) of the new first lens. Following the installation of the new first lens, at step 916, a new second lens is inserted into light fixture 100. For example, the new second lens is inserted through first cutout 146 and second cutout 156, underneath second slots 144 and 154 and end slot 132. At step 918, second lens bar 220 is reattached. For example, second flange 226 of second lens bar 220 engages the second row of tabs 181, coupling second lens bar 220 to light fixture 100. The first flange 224 of second lens bar 220 secures the free end (e.g., opposite the end secured by end slot 132, etc.) of the new second lens. At step 920, driver cover 170 is reattached to light fixture 100. Thereby, first lens bar 210 and second lens bar 220 become fixed in their respective locations, securing both the new first lens and the new second lens to light fixture 100.

Figure 10:
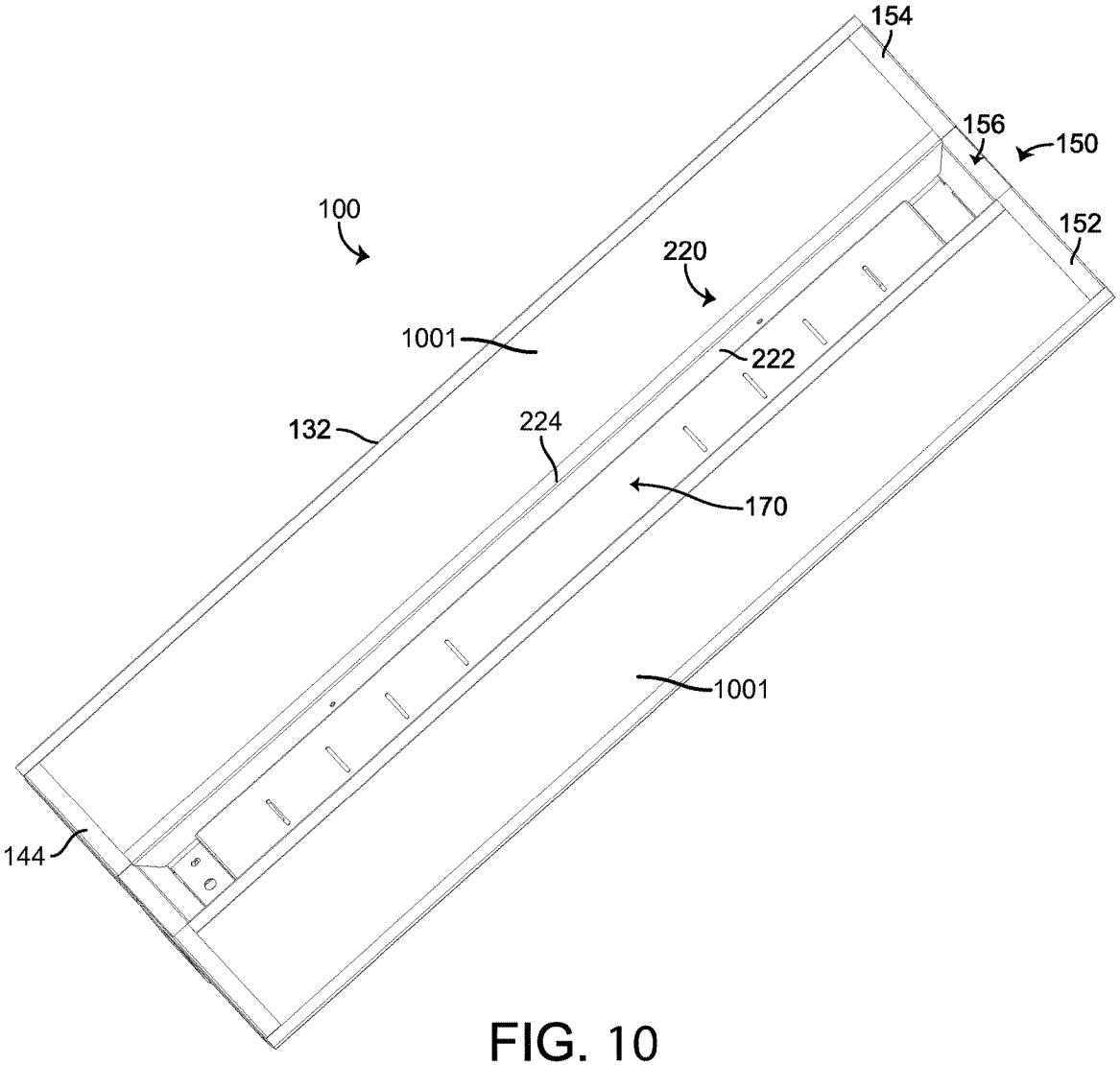
FIG. 10 is a top perspective view of a light fixture with installed lenses according to an exemplary embodiment.

Referring now to FIG. 10, light fixture 100 is illustrated according to one embodiment in which lenses 1001 are installed. Lenses 1001 are secured by slots 132 of flanges 130. Lenses 1001 are further secured by slots at the ends of light fixture 100 (e.g., slots 154 and 152). Lens bars (e.g., lens bar 220) overhangs lens 1001 and further secures lens 1001. Lens bar 220 is prevent from moving relative to light fixture 100 by tabs 180 and interference between body portion 222 of lens bar 220 and cover 170

In some embodiments, slots 132 are a flange portion or overhang which is formed from flange 130 of the body of light fixture 100. Slot 132 may be a void formed between a bent portion or flange portion extending from flange 130 of the body of light fixture 100. The flange portion may overhang lens 1001 along the entirety, or a substantial portion (e.g., greater than half), of one side of lens 1001. The flange portion (e.g., slot 132) may abut second slot 154 and/or other slots of light fixture 100. In other words, slots 132 may be a lip or channel which receives lens 1001 and/or supports lens 1001 from underneath lens 1001.

Advantageously, lens bar 220 may be coupled to light fixture 100 without tools as described with reference to FIGS. 2B, 2C, and 8-9. Lens 1001 may be slid into light fixture 1001 through cutout 156 and into slot 154. Lens 1001 may be received or otherwise secured by slot 132 (e.g., a lip, flange, or overhang of flange 130 of the body of light fixture 100). Second flange 226 of lens bar 220 may be inserted into tabs 180 and first flange 224 may be positioned above lens 1001. First flange 224 may support lens 1001 from below. Additionally, the angle formed by first flange 224 meeting body portion 222 of lens bar 220 may support lens 1001 horizontally. Lens 1001 may be secured between slot 132 (e.g., an angle formed by a flange portion or overhang meeting a vertical, substantially vertical, or angled portion of flange 130 of the body of light fixture 100) and the angle formed by first flange 224 and body portion 222 of lens bar 220. These features may prevent horizontal motion of lens 1001. These features may further support lens 1001 from below. Slot 154 and/or other slots may prevent vertical movement of lens 1001 as well (e.g., slot 154 has an upper and lower portions, or overhangs, which form a void in which lens 1001 is located).

In one embodiment, first flange 224 of lens bar 220 abuts slots 154 and/or 144. First flange 224 may run the entire length or a substantial length of lens bar 220. First flange 224, slot 154, slot 132 (e.g., a flange portion extending from flange 130 and over lens 1001), and slot 144 may form a frame or bezel which surrounds all or substantially all of the edges of lens 1001. There may be no or substantially no gaps between first flange 224 , slot 154, slot 132 (e.g., a flange portion of flange 130), and slot 144 (e.g., these features may meet at right angles to one another). Advantageously, this may both secure lens 1001 and provide for an aesthetically pleasing appearance. These features may be mirrored across cover 170.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

What is claimed is:

1. A light fixture, comprising:

a housing including a light source and slots configured to receive and secure a lens;

a lens bar having a first flange configured to secure the lens and a second flange configured to be releasably secured to the housing, a securing mechanism coupled to or integrated with the housing, the securing mechanism configured to releasably secure a portion of the second flange; and a removable panel, wherein the lens bar is secured in place with the second flange secured by the securing mechanism and by the removable panel which prevents the lens bar from moving laterally with respect to the securing mechanism, and wherein the slots and the first flange, running the length of the light fixture perpendicular to the slots, cover the edges of the lens.

2. The light fixture of claim 1, wherein the securing mechanism includes a single slot or tab running a substantial length of the light fixture.

3. The light fixture of claim 1, wherein the securing mechanism includes two single slots or tabs running a substantial length of the light fixture, each slot or tab located on different sides of the removable panel.

4. The light fixture of claim 1, wherein the securing mechanism includes one or more slots configured to accept quarter turn screws and wherein the second flange of the lens bar includes one or more quarter turn screws or openings through which a shank of the quarter turn screw may pass and through which a head of the quarter turn screw may not pass.

5. The light fixture of claim 1, further comprising a fin coupled to the housing using fasteners which also couple one or more light emitting diodes to the housing.

6. The light fixture of claim 1, further comprising two lenses.

7. The light fixture of claim 1, further comprising a single lens.

8. The light fixture of claim 1, wherein the securing mechanism and the removable panel are configured to allow for the changing of a lens without the use of tools.

9. A light fixture system for tool-less installation of lenses, comprising:

(A) a housing including:

a light source;

a base portion extending outward from the center of the housing and configured to secure the light source, the base portion further including a flange securing mechanism and furthering including slots to receive a lens; and an end plate including a slot configured to receive a lens and a cutout configured to allow the lens to be inserted into the slot;

(B) a lens bar including:

a first flange configured to overhang a lens and secure the lens;

a body portion; and a second flange configured to engage with the flange securing mechanism of the base portion to secure the lens bar to the housing; and (C) a removable panel configured to be coupled to the housing, wherein the removable panel prevents lateral movement of the lens bar, relative to the flange securing mechanism, through inference between the removable panel and the body portion of the lens bar.

10. The light fixture system of claim 9, wherein the securing mechanism includes a single slot or tab running a substantial length of the light fixture.

11. The light fixture system of claim 9, wherein the securing mechanism includes two single slots or tabs running a substantial length of the light fixture, each slot or tab located on different sides of the removable panel.

12. The light fixture system of claim 9, wherein the securing mechanism includes one or more slots configured to accept quarter turn screws and wherein the second flange of the lens bar includes one or more quarter turn screws or openings through which a shank of the quarter turn screw may pass and through which a head of the quarter turn screw may not pass.

13. The light fixture system of claim 9, further comprising a fin coupled to the panel of the housing using fasteners which also couple the one or more light emitting diodes to the panel.

14. The light fixture system of claim 9, further comprising two lenses.

15. The light fixture system of claim 9, further comprising a single lens.

16. The light fixture system of claim 9, wherein the securing mechanism and the removable panel are configured to allow for the changing of a lens without the use of tools.

* * * * *